US006244554B1

(12) United States Patent
Baker

(10) Patent No.: US 6,244,554 B1
(45) Date of Patent: Jun. 12, 2001

(54) VERSATILE STEMWARE HOLDER

(75) Inventor: John F. Baker, Pleasant Hill, CA (US)

(73) Assignee: Rachman Scientific, Inc., Concord, CA (US)

( * ) Notice: Subject to any disclaimer, the term of this patent is extended or adjusted under 35 U.S.C. 154(b) by 0 days.

(21) Appl. No.: 09/490,746

(22) Filed: Jan. 25, 2000

Related U.S. Application Data

(63) Continuation-in-part of application No. 29/061,924, filed on Nov. 25, 1996, now Pat. No. Des. 419,402, which is a continuation of application No. 29/054,220, filed on May 10, 1996, now abandoned.

(51) Int. Cl.[7] ..... A47K 1/08

(52) U.S. Cl. ..... 248/312; 215/396; 220/23.83

(58) Field of Search ..... 248/311.2, 312, 248/315, 213.2; 215/396; 294/87.22, 87.28, 165; 220/737, 23.23; D7/708

(56) References Cited

U.S. PATENT DOCUMENTS

| | | | |
|---|---|---|---|
| D. 115,619 | 7/1939 | Goodwin . | |
| D. 342,421 | 12/1993 | DuBow . | |
| 1,377,931 | 5/1921 | Samuels . | |
| 3,224,625 * | 12/1965 | Sperl | 22/23.83 |
| 4,943,017 * | 7/1990 | Ennis | 248/102 |

OTHER PUBLICATIONS

Brochure, "Stemcaddy Twosome Wine Glass Carrier", undated.

* cited by examiner

*Primary Examiner*—Ramon O. Ramirez
(74) *Attorney, Agent, or Firm*—Donald L. Beeson

(57) ABSTRACT

A versatile stemware holder includes a vertically extending center sleeve, stemware holding arms extending from the exterior wall of the center sleeve, and split ring stemware holders at the distal ends of the stemware holding arms. The center sleeve of the stemware holder is sized to fit over the neck of a bottle-shaped container such as a wine or champagne bottle. A resilient liner is provided for the sleeve for bracing the sleeve to the bottle neck such that the stemware holder stays firmly in place when the bottle-shaped container is moved or jostled. The stemware holder additionally includes billboard platform structures and openings in the extension section of the stemware holding arms for displaying additional celebration and special occasion related articles such as flowers, note cards, valentines, bows, and the like. Risers attachable to the stemware holder and a display platform attachable to the risers are additionally provided for additional display versatility.

23 Claims, 9 Drawing Sheets

VERSATILE STEMWARE HOLDER

CROSS-REFERENCE TO RELATED APPLICATIONS

This application is a continuation-in-part of application Ser. No. 29/061,924, filed Nov. 25, 1996, now Des. 419,402, which is a continuation of application Ser. No. 29/054,220, filed May 10, 1996, now abandoned.

BACKGROUND OF THE INVENTION

The present invention generally relates to display apparatus, and more particularly to stemware holders for displaying stemware with a bottle-shaped beverage container such as a wine or champagne bottle. The present invention provides a display structure which can also be used for displaying other celebration and special occasion related articles, such as flowers, toothpick flags, cards, valentines, stuffed animals, wedding cake tops, paper cut-outs, and the like. The invention can further be versatilely used as a merchandise display for wine, food products, flowers, and other articles of merchandise.

Heretofore, stemware holders have been devised to hold stemware on the neck of a wine or champagne bottle to display stemware in conjunction with the bottle. One such stemware holder is disclosed in U.S. Design Pat. No. Des. 342,421, issued to Steve DuBow. The DuBow patent illustrates a holder for stemware glasses having a planar body with a central opening for receiving the neck of the bottle. Four projecting edges having slotted openings that receive and suspend four stemware glasses upside down at each of the projecting edges of the holder. Such prior stemware holders have the disadvantage that the stemware holder rests loosely on the neck of the bottle and has a tendency to tilt or wobble on the bottle when the bottle is moved or when any uneven pressure is applied to the holder. Stemware holders such as disclosed in the DuBow patent are generally difficult to use other than in a carefully balanced display which does not cause the holder to tilt. Stemware glasses can also easily fall off such holders causing breakage of the stemware.

A need, therefore, exists for a stemware holder that can be rigidly braced on the neck of a wine or champagne bottle or other bottle-shaped container. A need also exists for a stemware holder that can versatilely support and display other articles such as flowers, cards, valentines, bows, stuffed animals, wedding cake tops, paper cut-outs, and the like for producing decorative and attractive displays for celebrations or other occasions or special events. A need still further exists for a stemware holder that can display stemware and other articles without the risk that the stemware or other articles will dislodge upon movement of the display.

The present invention overcomes the above-mentioned disadvantages of conventional stemware holders, and fills the need for a stemware holder that can support the display of other celebration and special occasion related articles. The present invention provides a stemware holder which can be firmly braced on the neck of a bottle-shaped container, which is versatile, and which will not easily be dislodged upon movement of the container.

SUMMARY OF THE INVENTION

Briefly, the invention is a stemware holder capable of displaying stemware on a bottle-shaped beverage container having a narrow neck. The stemware holder is comprised of a vertically extending center sleeve having a top end, a bottom end, and an exterior wall. The center sleeve is sized to fit over the neck of the bottle-shaped beverage container, providing an extended structure to stablely hold the stemware holder to the neck of the container. At least one stemware holding arm extends from the center sleeve of the holder and has a distal end with a split holding ring for receiving and holding a stemware item. One or more resilient liner elements are provided for the interior wall of the center sleeve to rigidize the center sleeve with respect to the bottle neck so that the stemware holder will be rigidly held in position on the bottle. Bumper points or other bumper means preferably project from the top interior edges of the split holder ring of the stemware holding arm in order to engage and raise the bowl portion of the stemware off of the split ring. Such bumper points act to vertically stabilize the stemware on the holder and protect the stemware bowl from being scratched by the holder.

In its preferred embodiment, it is contemplated that the stemware holder will have at least two stemware holding arms symmetrically extending from the center sleeve of the holder for providing a balanced holding apparatus. However, the invention is not limited to a symmetrical apparatus and could be provided with a single extending stemware holding arm or three or four holding arms symmetrically or non-symmetrically spaced around the center sleeve.

In a further aspect of the invention, at least one, and suitably two billboard platforms are additionally provided on the exterior wall of the center sleeve for holding celebration and other special occasion related articles to the stemware holder. For example, the billboard platform can have a vertical adhesive face for attaching and displaying seasonal symbols, e.g. hearts or four leaf clovers, personalized cards, bows, or other relatively lightweight articles to the center sleeve of the stemware holder for embellishing the overall display of the holder. Alternatively, message cards, or other flat articles could be propped up on top of the billboard platforms so as to rest against the center sleeve.

In still a further aspect of the invention, the extension sections of the stemware holding arms can be provided with openings, suitably in the form of longitudinal channels, for receiving and holding additional celebration and special occasion related articles. For example, the opening in the extension section of the stemware holding arms can be used to hold one or more florist water vials with a rose or small bouquet of flowers held in the vials to create a floral display.

In yet another aspect of the invention, vertical riser members having base and distal ends are provided along with a riser fastening structure in the stemware holding arms. The base end of the risers can be attached to the riser fastening structure on the stemware holding arms to produce a stemware holder assembly from which yet additional articles can be displayed. Still further, a display platform fixed to the distal ends of the risers can be used to support a variety of articles, for example, a wedding cake top or stuffed animal. In the illustrated embodiment of the invention, the base end of the riser snap fits into elongated channels in the extension section of the stemware holding arms.

It is contemplated that a stemware holder assembly comprised of the stemware holder of the invention, risers and a display platform on top of the risers can be used to hold stemware on the neck of a bottle-shaped container with various celebration and special occasion related articles displayed from the stemware holder, or reversed such that the display platform and risers serve as a stand for the stemware holder such that the stemware holder can be used to display a variety of articles, including stemware, flower bouquets, valentines, bows, stuffed animals, either separately or in combination.

Therefore, it can be seen that a primary object of the invention is to provide a stemware holder capable of firmly holding stemware and other celebration and party related articles to the neck of a bottle-shaped container, such as a wine or champagne bottle. It is a further object of the invention to provide a stemware holder that can versatilely be deployed to create a variety of displays and arrangements with celebration and other special occasion related articles. Other objects of the invention will be apparent from the following specification and claims.

DETAILED DESCRIPTION OF THE ILLUSTRATED EMBODIMENT

Figure 1:
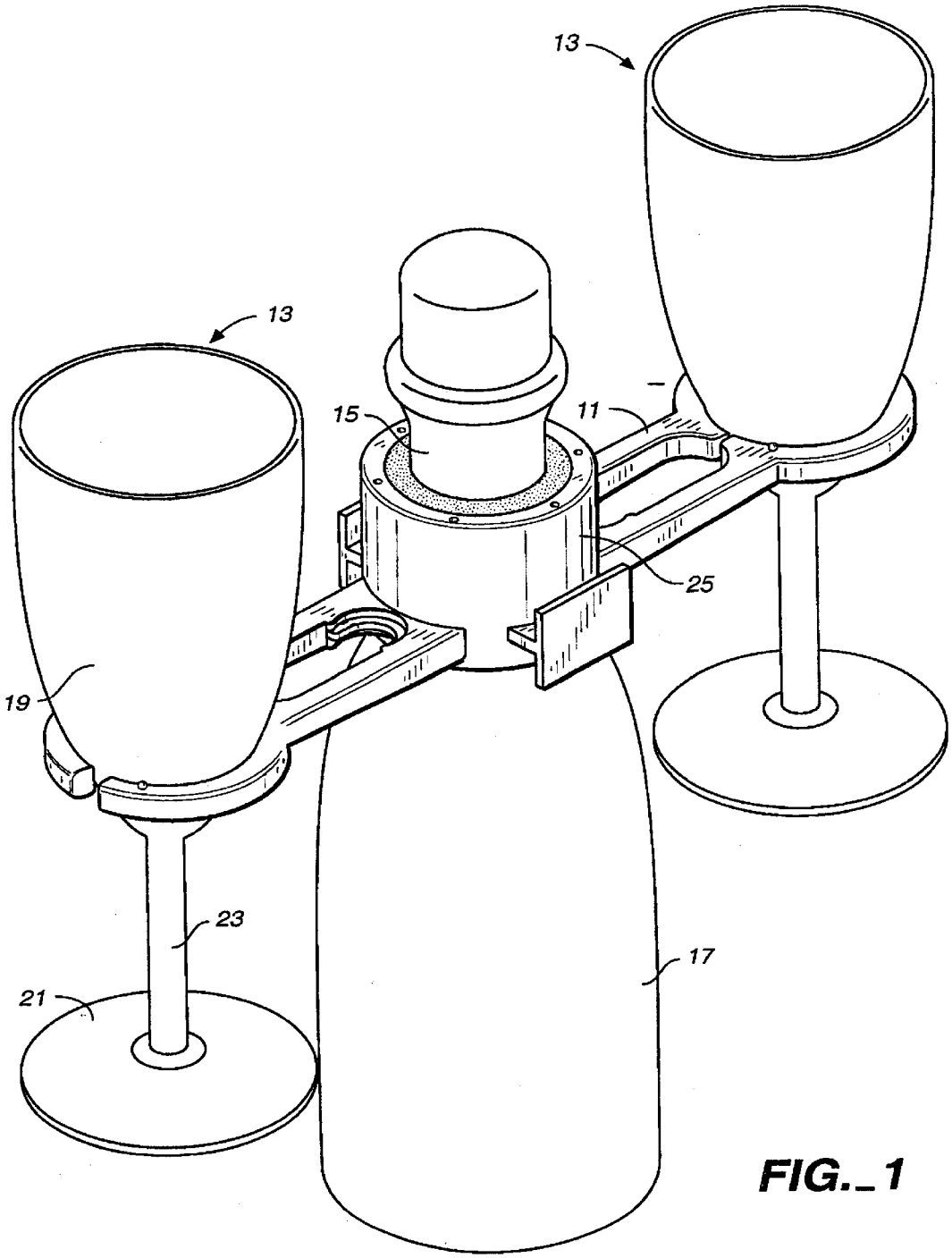
FIG. 1 is a top perspective view of a stemware holder in accordance with the invention showing two stemware glasses held adjacent the neck of a bottle-shaped container.

Referring to FIG. 1, the invention generally involves a stemware holder 11 for holding stemware glasses 13 to the neck 15 of a bottle-shaped container 17, such as a bottle of wine or champagne. The stemware 13 is suitably in the form of beverage stemware, however, other forms of stemware could be used, such as pewter or plastic stemware. Each stemware glass 13 has a bowl end 19 connected to a base 21 by a stem 23. In FIG. 1, it can be seen that the stemware holder suitably holds the stemware bowl end up as opposed to bowl end down as in most conventional stemware holders. As will be described below, the stemware holder can be used to hold and display articles other than stemware in a fashion that permits the creation of an attractive display of a variety of celebration and other special occasion related articles, such as flowers, cards, valentines, bows, stuffed animals, wedding cake tops, toothpick flags, paper cut-out and the like.

The construction of the stemware holder will be described in greater detail in reference to FIGS. 2–6 of the drawings. The stemware holder includes a vertically extending cylindrically-shaped sleeve 25 having a top end 27, a bottom end 29, a cylindrical exterior wall 31 and a cylindrical interior wall 33. A resilient liner member 35 is provided for insertion between the sleeve's interior wall 33 and the neck 15 of the beverage-shaped container (see FIG. 1) for bracing the holder to the neck of the bottle so as to prevent the stemware holder from wobbling or tilting on the bottle when stemware or other articles are placed on the stemware holder. The liner 35 is suitably fabricated of a closed cell foam material such as 4 lb. density ethylene vinyl acetate, and has a relatively narrow width as compared to the length of the center sleeve 25 to permit the liner to be easily inserted in the gap between the center sleeve and the bottle neck as hereinafter described.

The illustrated stemware holder of the invention further includes two stemware holding arms 37 symmetrically extending from the stemware holder's center sleeve 25. A split ring holder 39 is formed on the distal end 41 of each of the holding arms for receiving and holding a stemware glass 13 as shown in FIG. 1. Ring 39 is split at its outer edge to form a narrow gap 43 of sufficient width to accommodate the stem 43 of a stemware glass. This gap can suitably be slightly larger than the diameter of a conventional stem to permit a stemware glass to be easily inserted into and removed from the ring. Conversely, the gap 43 can be somewhat smaller than the stemware such that a slight manual expansion of the ring is required to insert and remove the glass, thereby insuring that the glass will not inadvertently be dislodged from the ring.

Figure 2:
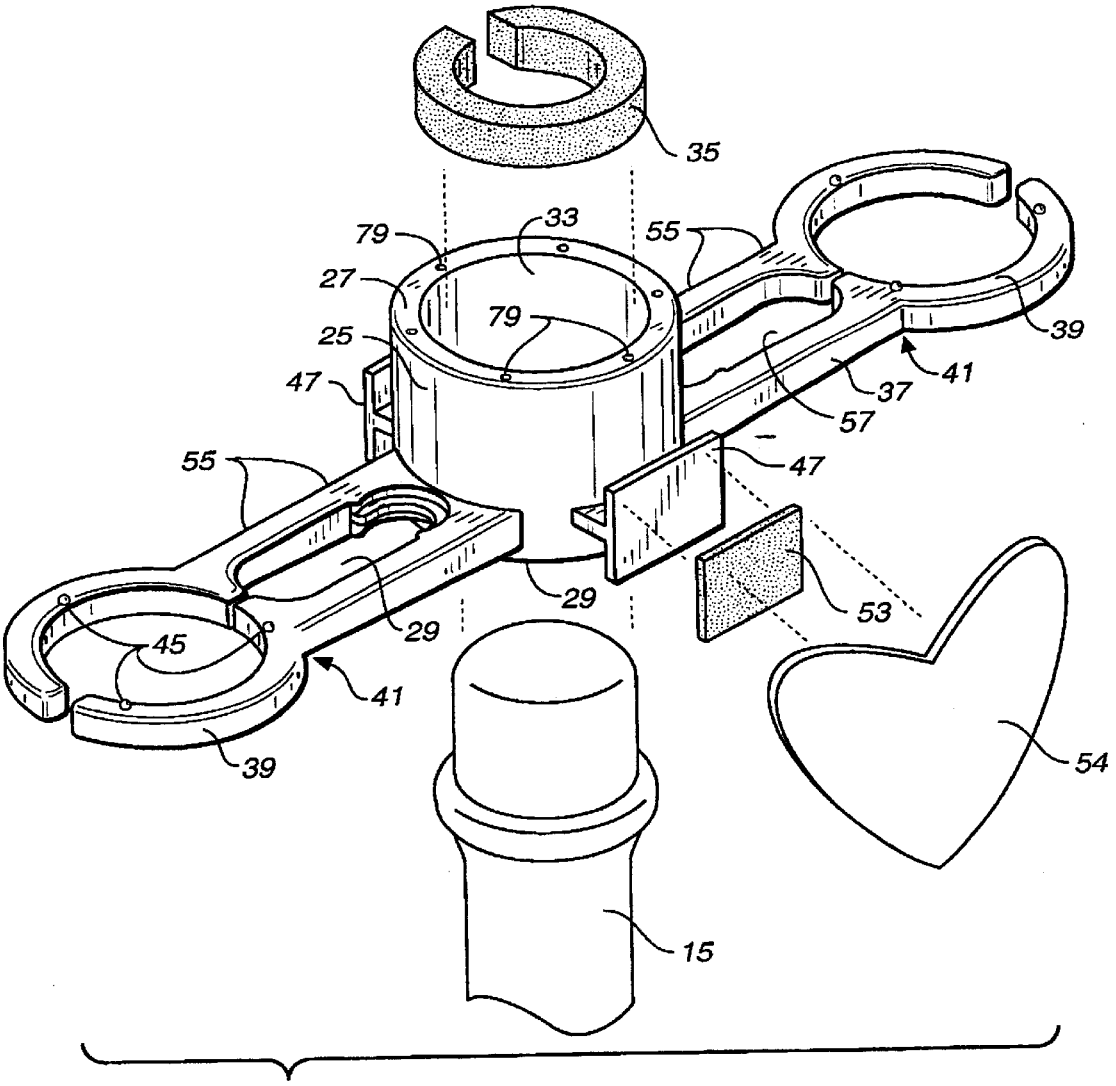
FIG. 2 is a top perspective view thereof without the glasses and bottle shown in FIG. 1 but showing a valentine symbol adhered to a billboard structure of the stemware holder.
Figure 4:
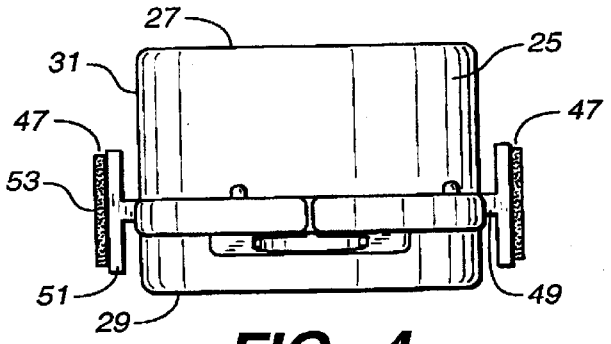
FIG. 4 is an end elevational view thereof.
Figure 3:
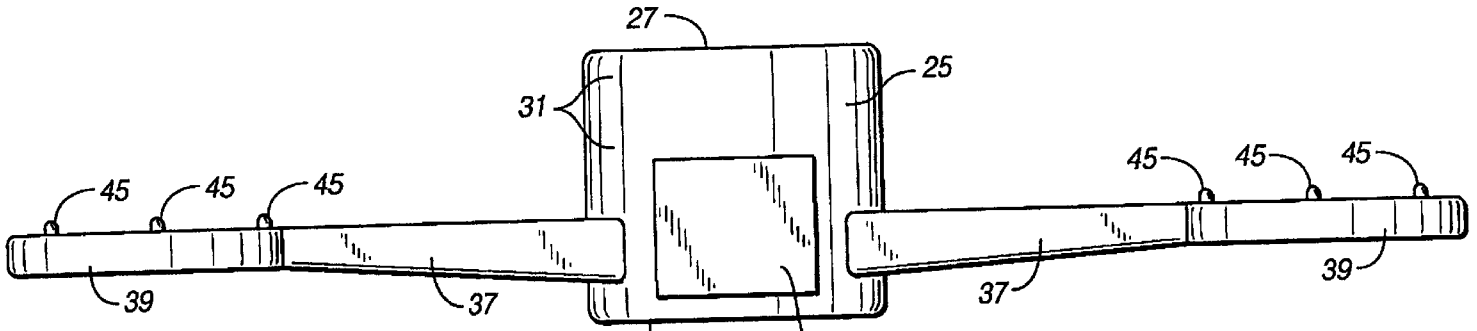
FIG. 3 is a side elevational view thereof.
Figure 5:
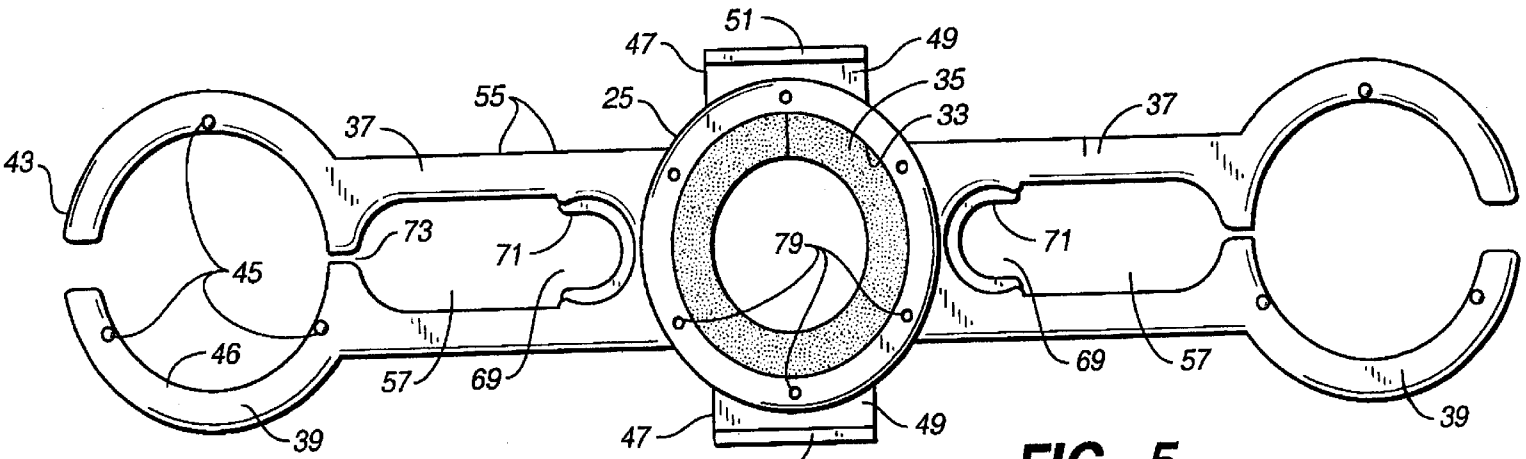
FIG. 5 is top plan view thereof.

As best shown in FIGS. 2, 3 and 5, the holder rings 39 at the distal ends of the stemware holding arms 37 further include three bumper points 45 that project vertically from the top interior edge portion 46 of holder rings. These bumper points, which are seen to be evenly spaced around this interior edge, engage the bowl 19 of stemware glass 13 to raise the stemware glass off of the holder ring. Without these bumper point structures, the stemware glass will tend to slide within the ring holder causing the glass to tilt with movement or jostling of the stemware holder. The bumper points tend to stabilize the glasses and keep them vertically upright. Other vertical stabilization bumper means might be employed, such as providing a rubber coating or adhesive strip around the holder ring's top interior edge portion 46. However, the illustrated bumper points can be molded into the ring holder at low cost and will provide a degree of vertical stabilization with minimum tendency to smudge, mark or scratch the exterior surface of the stemware.

In addition to the ring holders 39, stemware holder 11 further includes structures for holding and displaying other celebratory and special occasion related articles, including billboard platform structures 47 extending from center sleeve 25 at right angles to the stemware holding arms 37. Each billboard platform structure includes a short horizontal extension leg 49 and a vertical member in the form of vertical plate 51 at the end of the extension leg. Preferably, the vertical plate 51 is provided with an adhesive face 53 to which lightweight articles such as a valentine symbol 54 or a greeting card, bow or the like can be adhered as illustrated in FIG. 2. Similarly, the billboard structures can be used to support card-like articles by resting such articles on the extension leg 49 of the structure behind the vertical plate 51. It is seen that the billboard structures are positioned near the bottom end 33 of center sleeve 25 such that the upwardly extending portion of the center sleeve can act as a backstop for a card or similar article supported on the billboard's extension leg. For aesthetic symmetry, the stemware holding arms are similarly positioned near the bottom end of the center sleeve. However, the stemware holding arms could be placed vertically anywhere along the center sleeve without impairing their function.

To further expand the versatility of the stemware holder, the extension section 55 of each of the stemware holding arms 37 includes an opening in the form of a longitudinally extending channel 57 for holding additional celebration and special occasion related articles. An example of a celebration related article that can be held in channels 57 of the extension arms 37 illustrated in FIGS. 6 and 9, wherein florist water vials 59 hold small bouquets of flowers 61 between the holder center sleeve 25 and ring holders 39.

Figure 6:
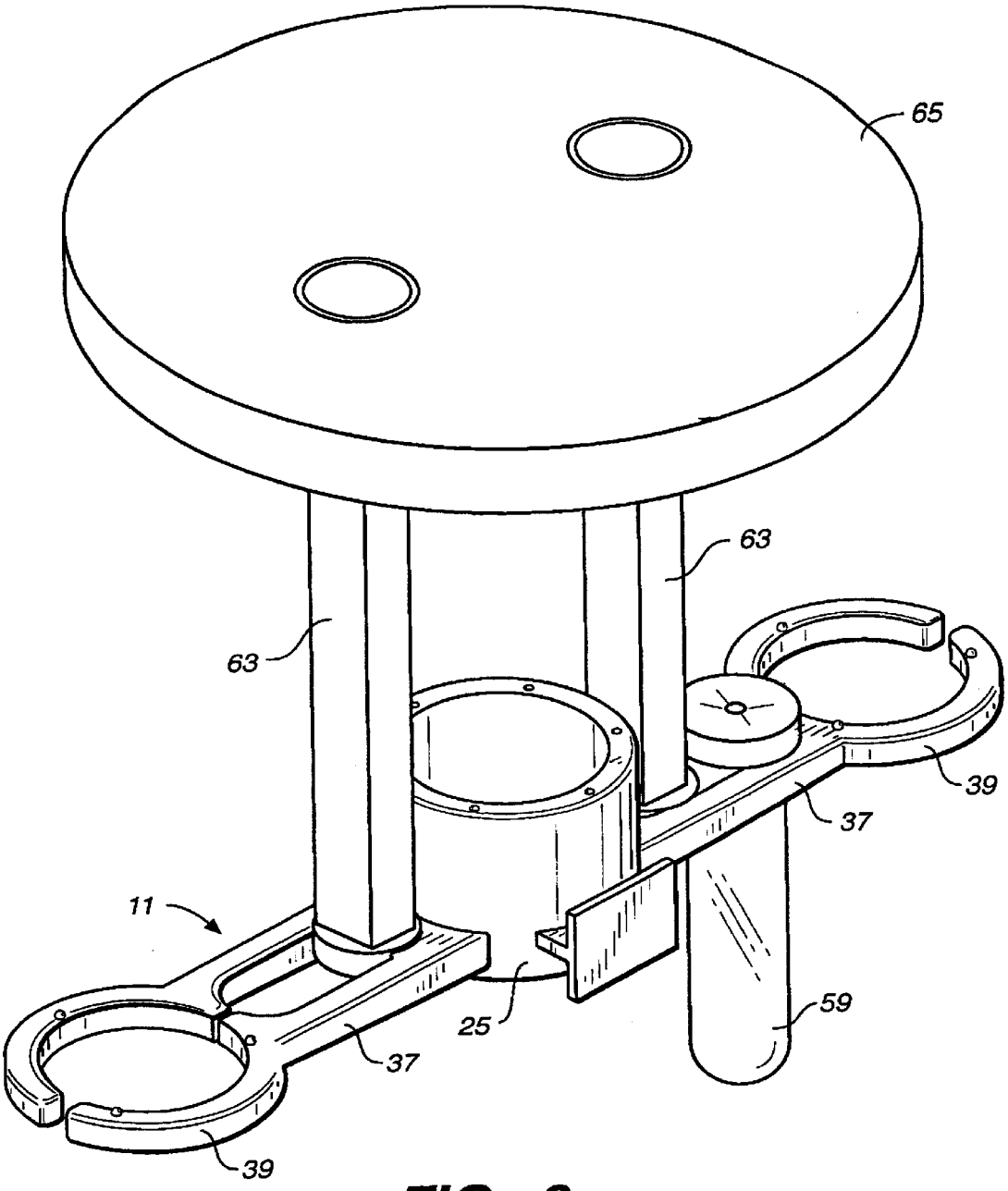
FIG. 6 is a top perspective view of a stemware holder assembly comprised of a stemware holder as shown in FIGS. 1–6, vertical risers and a display platform.
Figure 7:
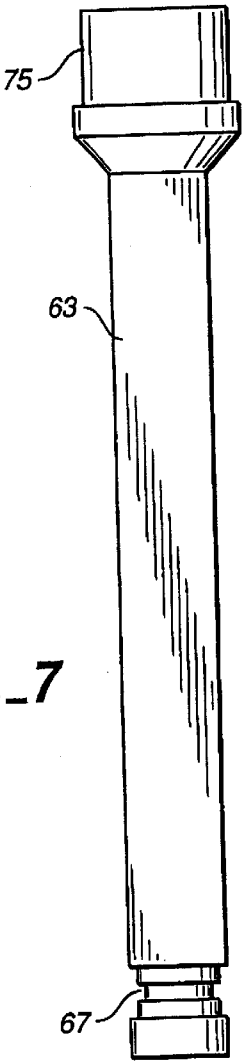
FIG. 7 is a side elevational view of a riser member used in the stemware holder assembly shown in FIG. 6.

Another use of the stemware holder channels 57 is shown in FIGS. 6 and 7 wherein a stemware holding assembly is formed by the stemware holder 11, risers 63, and a display platform 65. Each of the risers 63 is seen to have a grooved base end 67 which snap fits into interior locking ends 69 of the channel openings 57 of the holder's extension arms 37. Each of the channels locking ends have a radius and tongue structure 71 which engages and releasably locks with the grooved structure of a riser's base end. Interior expansion slots 73 in the ring holders 39 at the ends of the holding arms 37 permit the channel openings to be expanded slightly to accept the base ends of the riser members. These expansion slots should be smaller than the normal diameter of the stem 23 of the stemware glass 13 to prevent the glass from sliding into channel openings 57.

Figure 8:
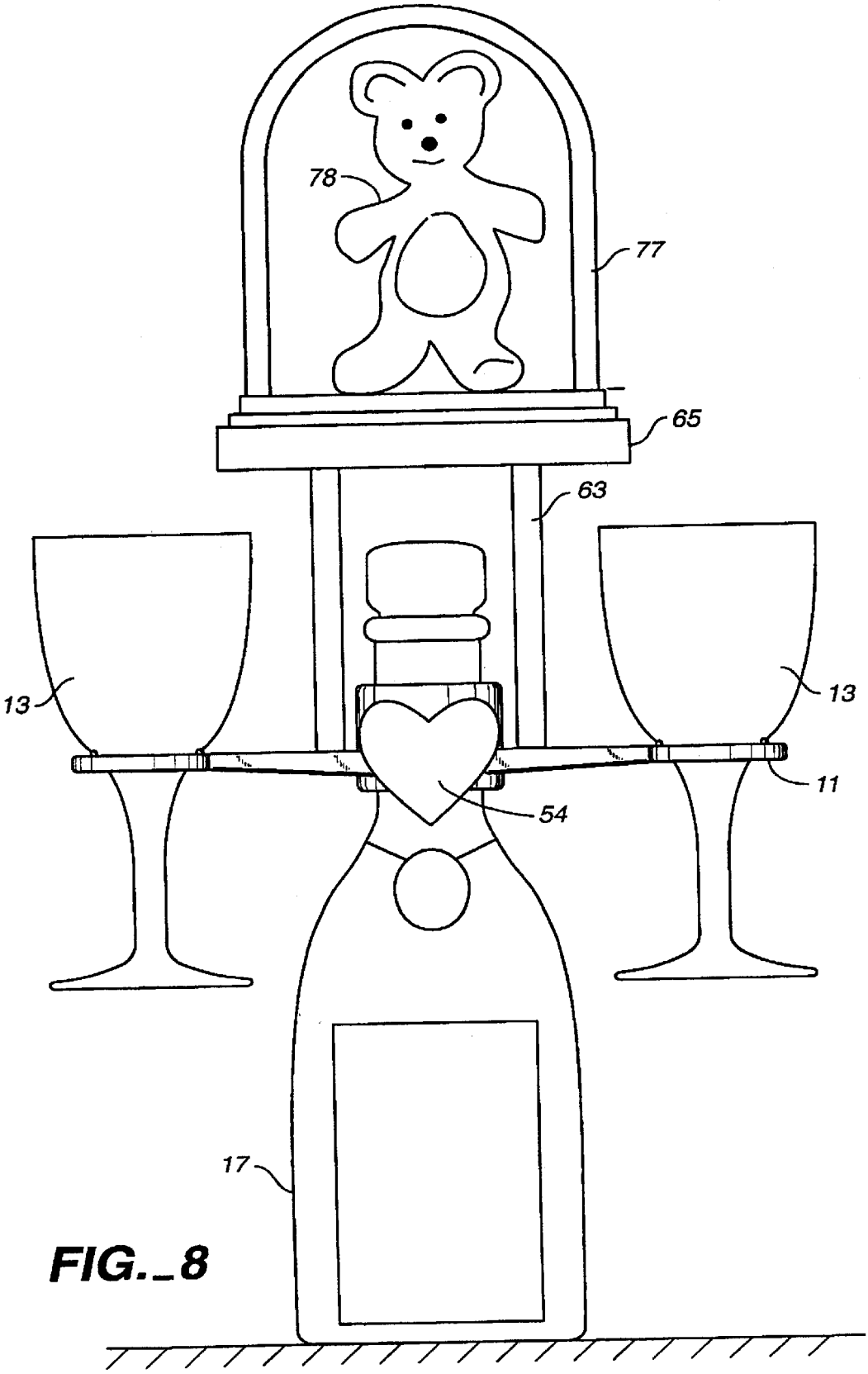
FIG. 8 is a side elevational view of the stemware holder assembly shown in FIG. 6 with wedding cake top, stuffed animal, and valentine display.

As shown in FIG. 6, the display platform 65 can be attached to the distal ends 75 of the riser members to provide a platform over the center sleeve 25 of the stemware holder on which a variety of articles can be placed. An example of the use of the display platform 65 is shown in FIG. 8 which shows a display platform supporting a wedding cake top 77 and stuffed animal toy 78. Sleeve openings (not shown) are suitably formed in and extend through the display platform for engaging the platform to the distal ends of the risers.

Figure 10:
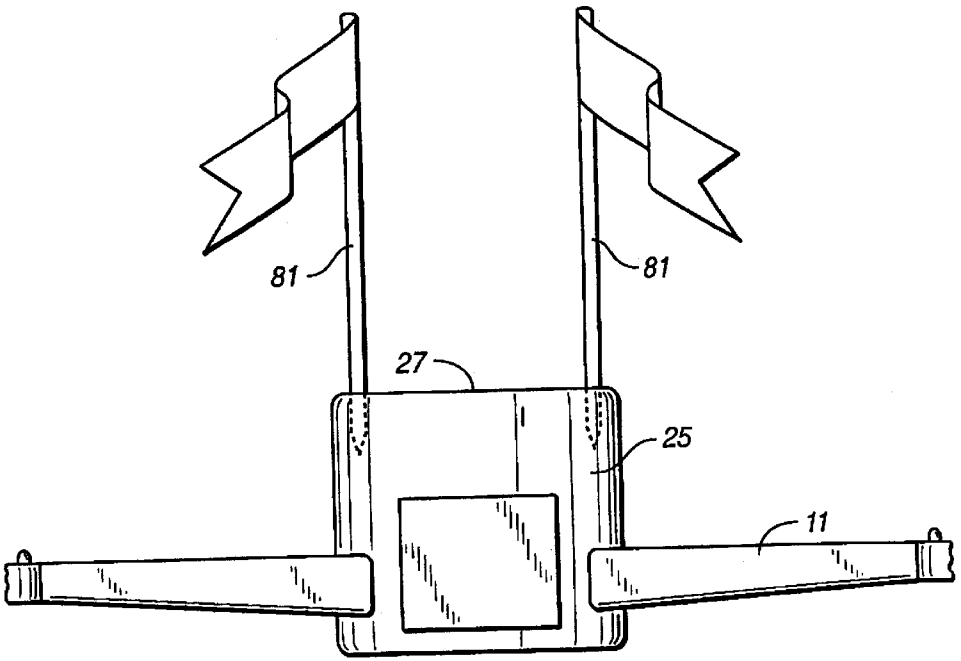
FIG. 10 is a side elevational view of the stemware holder shown in FIGS. 1–6 with a toothpick flag display.

Referring to FIGS. 2, 5 and 10, it can be seen that the stemware holder can be provided with further display versatility by providing a series of rim holes 79 (shown in FIGS. 2 and 5) around the top end 31 of center sleeve 25. As shown in FIG. 10, these sleeve holes can be used to hold toothpick flags 81 or other similar articles around the rim of the center sleeve.

Figure 10A:
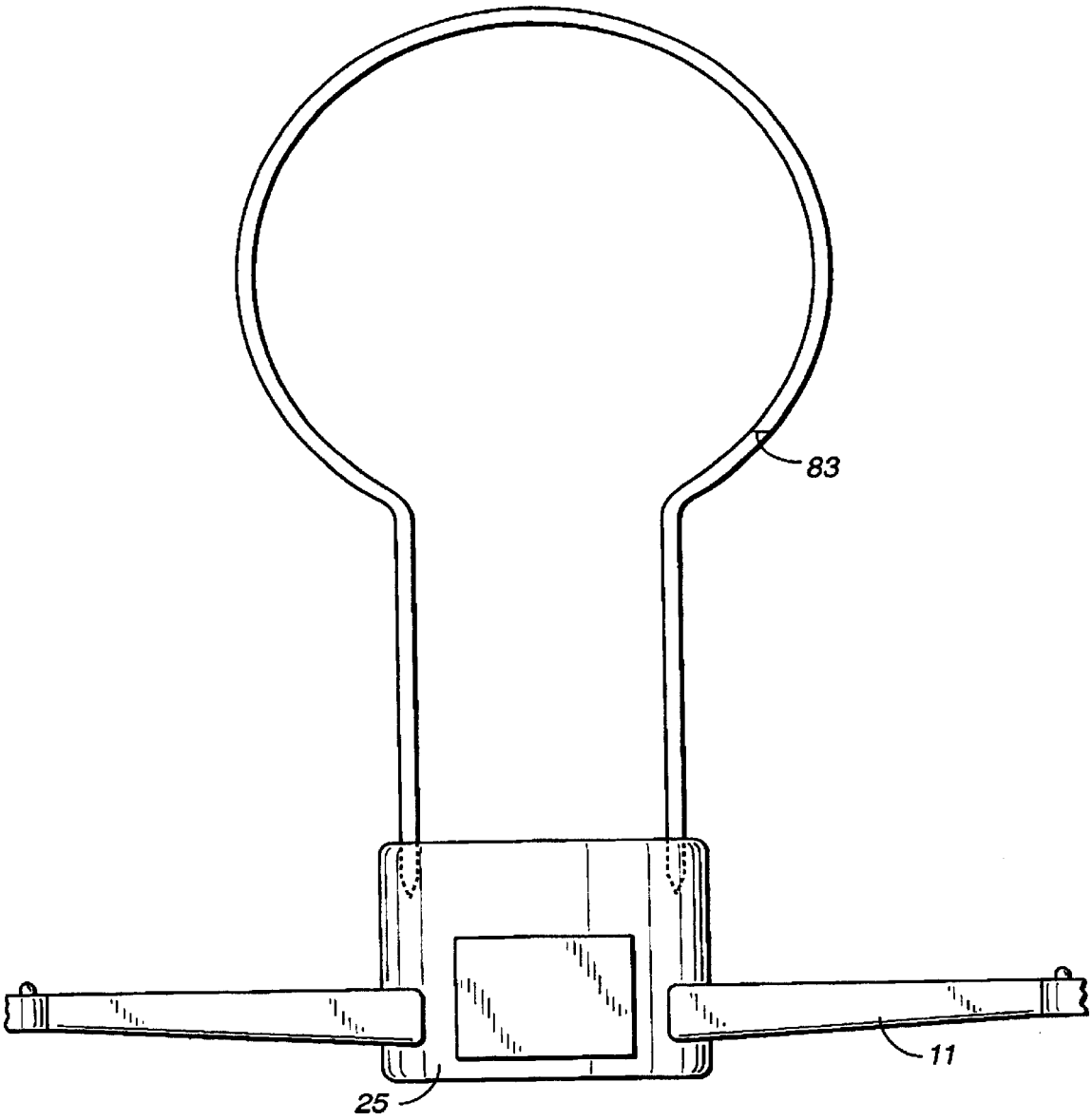
FIG. 10A is a side elevational view of the stemware holder of FIG. 10 with a wire loop for attaching paper cut-outs, flowers or other display articles.

FIG. 10A illustrates another use of the center sleeves rim holes 79. As shown in FIG. 10A, the two ends of a bent wire loop 83 are inserted into two of the center sleeves rim holes to provide a wire support for display articles such as paper cut-outs (not shown). An example of other items that could be attached to this wire loop: small flowers or ivy to create a floral or plant arrangement over the center sleeve. It can be appreciated that a wide variety of different displays can be created using the various facilities of the stemware holder, and accessory riser members and display platform.

Figure 9:
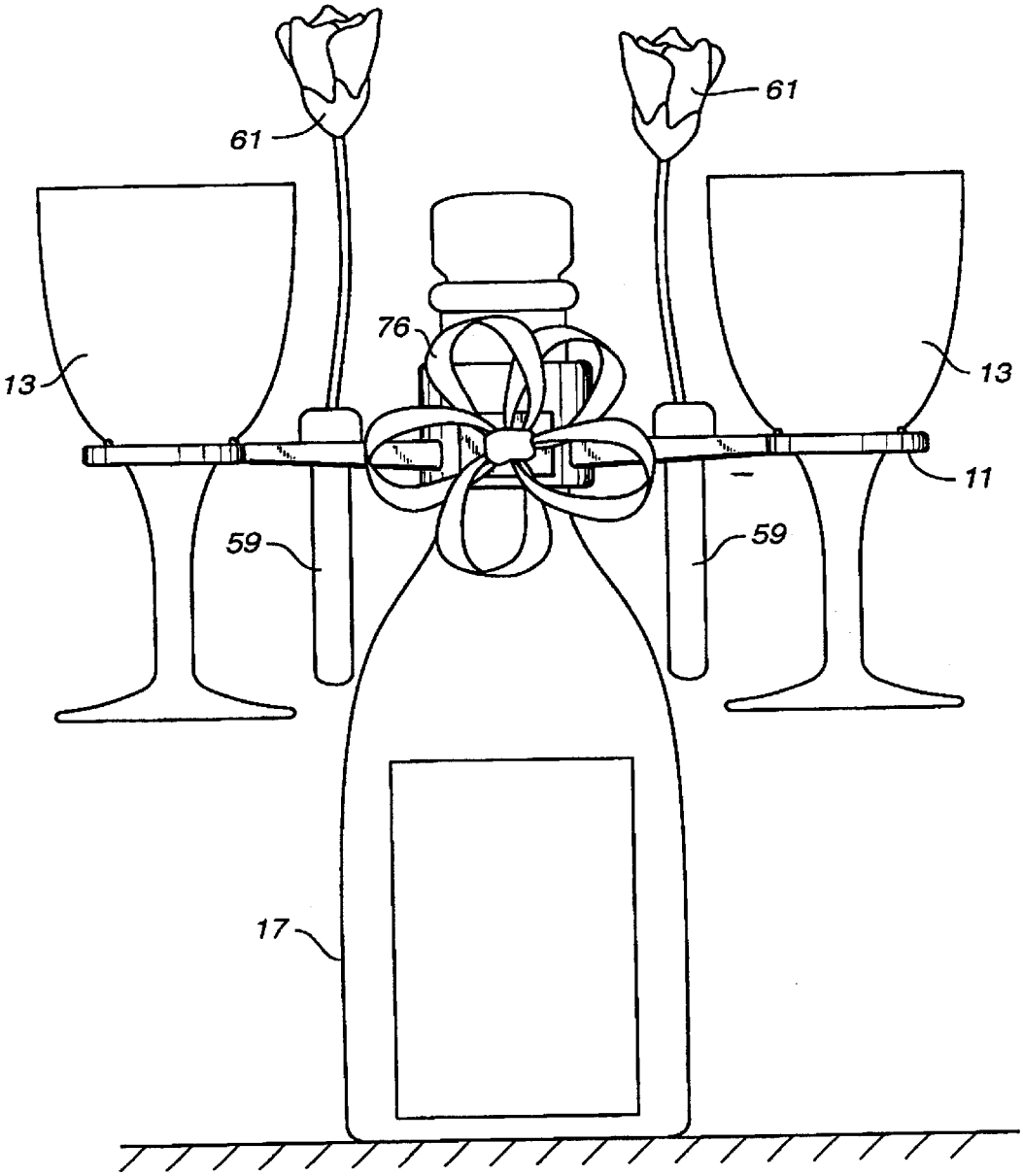
FIG. 9 is a side elevational view of the stemware holder assembly shown in FIG. 6 with a floral display.

To use the stemware holder of the invention, and to create a display such as shown in FIGS. 8–10, the stemware holder is first placed on the neck of a bottle-shaped container by fitting the center sleeve 25 of the stemware holder onto the bottle neck. As best illustrated in FIG. 2, the sleeve liner 35 is then inserted at the top end of the center sleeve by pressing it into the gap between the center sleeve and the bottle neck for rigidizing the stemware holder with respect to the bottle neck. If it is difficult to insert the liner because of the size of this gap (bottle will have different diameters), the sleeve liner can be cut into shorter lengths or otherwise trimmed. Suitably, the foam liner can be pre-scored or partially cut to facilitate the separation of the liner into smaller sections for this purpose.

On occasions where the riser members 63 and display platform are used, the riser members are first installed on the stemware holder by placing the base end 67 of the risers into the respective channel openings 57 of stemware holding arms 37. The risers base ends are first snapped into the center portion of the channel openings 57 and then slid into the channels locking ends 69. Once the riser members are in place, the display platform is easily fitted on top of the risers using sleeve openings in the display platform. This entire assembly is then placed over the bottle neck with the sleeve liner as previously described.

Figure 11:
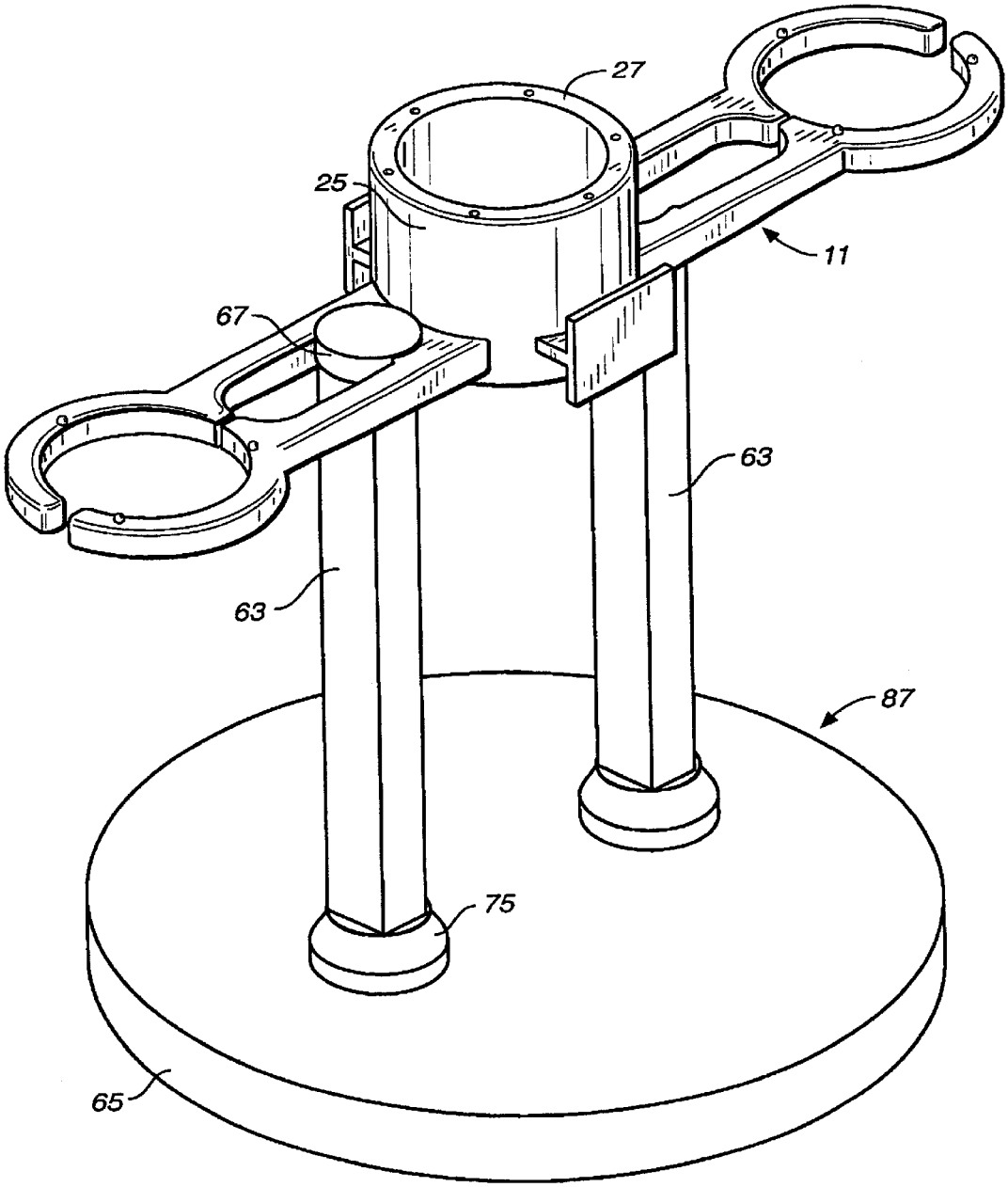
FIG. 11 is a top perspective view of a stemware holder assembly having the riser members and display platform reversed to form a stand for the stemware holder.

Referring to FIG. 11, it can be seen that the riser members and display platform can be reversed or turned upside down to provide a support stand 87 for the stemware holder. In this case, the base end 67 of riser members 63 would be engaged into channel openings 57 from the opposite side of the stemware holder. With such a support stand, the stemware holder 11 can be used to display stemware or other celebration and/or special occasion-related articles without the need for a supporting bottle-shaped container.

The stemware holder, risers, and display platform can be fabricated at low cost using an injection molding process and crystalline styrene plastic material. The display platform can also be provided with various openings, slots, and/or holes on which further displays can be created from wire loops, toothpick flags, billboard inserts, and the like.

Therefore, it can be seen that the present invention provides a versatile stemware holder and accessories therefor which can be used to create a wide variety of different displays for celebrations and other special occasions. The stemware holder and its accessories can be fabricated at relatively low cost, and can be firmly secured to the neck of bottle-shaped containers without the stemware holder moving or wobbling on the bottle neck. While the invention has been described in considerable detail in the foregoing specification and the accompanying drawings, it is not intended that the invention be limited to such detail, except as necessitated by the following claims.

What I claim is:

1. A versatile stemware holder capable of displaying stemware on a bottle-shaped beverage container having a neck, said stemware holder comprising a vertically extending center sleeve having a top end, a bottom end, and an exterior wall, and being sized to fit onto the neck of a bottle-shaped beverage container to hold the stemware holder to the neck of the container, and at least one stemware holding arm extending from said center sleeve, said stemware holding arm having a distal end and a split ring holder at said distal end for receiving and holding stemware.

2. The stemware holder of claim 1 wherein said center sleeve has a cylindrical interior wall and wherein a resilient liner element is provided for insertion between the interior wall of said center sleeve and the neck of a bottle shaped container for bracing said holder to the container.

3. The stemware holder of claim of claim 2 wherein said liner element is fabricated of a foam material.

4. The stemware holder of claim 1 wherein at least two stemware holding arms symmetrically extend from said center sleeve.

5. The stemware holder of claim 1 wherein the split ring holder of said stemware holding arm has a top interior edge portion and wherein a stemware buffer is provided around said top interior edge portion for engaging and vertically stabilizing stemware placed in the split ring holder of said arm.

6. The stemware holder of claim 5 wherein said stemware buffer includes at least three bumper points vertically projecting from the top interior edge portion of said stemware holder ring.

7. The stemware holder of claim 6 wherein said bumper points are symmetrically distributed about the top interior edge portion of said split ring distal end.

8. The stemware holder of claim 1 wherein at least one billboard platform structure extends from the exterior wall of said center sleeve, said billboard platform structure being formed to hold celebration and special occasion related articles thereto.

9. The stemware holder of claim 8 wherein said billboard platform structure has a substantially vertical adhesive face for adhesively attaching and holding celebration and special occasion related articles thereto.

10. The stemware holder of claim 8 wherein said billboard platform includes a horizontal extension leg on which celebration and special related articles can rest and a vertical member at the end of said extension leg for holding celebration and special occasion related articles upright on said extension leg.

11. The stemware holder of claim 10 wherein at least two billboard platforms symmetrically extend from said center sleeve.

12. The stemware holder of claim 1 wherein at least one anchoring hole provided at the top end of said center sleeve for selectively anchoring celebration and special occasion related articles thereto.

13. The stemware holder of claim 12 wherein a plurality of anchoring holes are distributed about the top end of said center sleeve.

14. The stemware holder of claim 1 wherein said stemware holding arm includes an extension section having an opening therein for receiving and holding celebration and special occasion related articles.

15. The stemware holder of claim 1 further comprising at least one vertical riser member having a base end and a distal end, said stemware holding arm having a riser fastening structure for receiving and detachably fastening the base end of said riser member to said holding arm to form a stemware holder assembly whereby celebration and special occasion related articles can be attached to the vertical riser member of said stemware holder assembly.

16. The stemware holder of claim 15 further comprising a display platform fixed to the distal end of said riser member.

17. The stemware holder of claim 16 wherein said display platform is detachable from the distal end of said riser.

18. The stemware holder of claim 15 wherein said stemware holding arm includes an extension section and wherein the riser fastening structure on said stemware holding arm includes a longitudinally extending channel in the extension section thereof for receiving holding the base end of said riser.

19. A versatile stemware holder capable of displaying stemware on a bottle-shaped beverage container having a neck, said stemware holder comprising a vertically extending center sleeve having a top end, a bottom end, an interior wall, and an exterior wall, and being sized to fit over the neck of a bottle-shaped beverage container to hold the stemware holder to the neck of the container, a resilient liner element insertable between the interior wall of said center sleeve and the neck of a bottle shaped container for bracing said holder to the container, at least two stemware holding arm extending from said center sleeve, each said stemware holding arm having a distal end and a split ring holder at said distal end for receiving and holding stemware, and at least one billboard platform structure extending from the exterior wall of said center sleeve between said stemware holding arms, said billboard platform structure being formed to hold celebration and special occasion related articles thereto.

20. The stemware holder of claim 19 wherein the split ring holder of said stemware holding arm has a top interior edge portion and wherein a stemware buffer is provided around said top interior edge portion for engaging and vertically stabilizing stemware placed in the split ring holder of said arm.

21. The stemware holder of claim 20 wherein said stemware buffer includes at least three bumper points vertically projecting from the top interior edge portion of said stemware holder ring.

22. The stemware holder of claim 19 further comprising at least two vertical riser members having a base end and a distal end, said stemware holding arms each having a riser fastening structure for receiving and detachably fastening the base end of one of said riser members to said holding arms to form a stemware holder assembly whereby celebration and special occasion related articles can be attached to the vertical riser members of said stemware holder assembly.

23. The stemware holder of claim 22 further comprising a display platform detachably fixed to the distal end of said riser member for supporting further celebration and special occasion related articles on said stemware holder assembly.

* * * * *